US006631898B2

(12) United States Patent
Dobrindt

(10) Patent No.: US 6,631,898 B2
(45) Date of Patent: Oct. 14, 2003

(54) GRIPPING ARRANGEMENT FOR THE STACKER OF A PRINTING PRESS

(75) Inventor: Dirk Dobrindt, Klausdorf/Schwentine (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/151,266

(22) Filed: May 20, 2002

(65) Prior Publication Data

US 2002/0185807 A1 Dec. 12, 2002

(30) Foreign Application Priority Data

Jun. 1, 2001 (DE) ..... 101 26 894

(51) Int. Cl.[7] ..... B65H 5/02

(52) U.S. Cl. ..... 271/85; 271/204; 271/207; 414/788.1; 198/750.11; 198/468.2

(58) Field of Search ..... 271/85, 306, 207, 271/204, 86; 198/750.11, 468.2; 414/788.1

(56) References Cited

U.S. PATENT DOCUMENTS 3,199,653 A * 8/1965 McGowan ..... 198/418.3
3,891,204 A * 6/1975 Mager ..... 271/85
4,058,307 A * 11/1977 Bubley et al. ..... 271/85
4,448,408 A * 5/1984 Faltin ..... 271/277
5,094,336 A * 3/1992 Lundstrom et al. .... 198/341.08
5,222,727 A 6/1993 Jacobsen
5,480,133 A 1/1996 Motev et al.

FOREIGN PATENT DOCUMENTS

DE 2 80 952 A1 7/1990
DE 100 47 395 A1 9/2000

* cited by examiner

*Primary Examiner*—Donald T. Walsh
*Assistant Examiner*—Kaitlin Joerger
(74) *Attorney, Agent, or Firm*—Lawrence P. Kessler

(57) ABSTRACT

A gripping arrangement for a stacker device or delivery tray of a printing press. At least one upper gripper arm and at least one lower gripper arm are provided, which have a first opened position and a second closed position. Sheets are located between the upper and lower gripper arms in the closed position. A first guiding device guides the gripping arrangement substantially in the vertical direction, and a second guiding device guides the gripping arrangement substantially in the horizontal direction.

7 Claims, 5 Drawing Sheets

GRIPPING ARRANGEMENT FOR THE STACKER OF A PRINTING PRESS

FIELD OF THE INVENTION

The invention relates to a gripping arrangement for the stacker or delivery tray of a printing press, such arrangement including a guide for guiding the gripping arrangement for movement in both the vertical and horizontal direction.

BACKGROUND OF THE INVENTION

With printing presses, sheets printed by passing through the printing module are delivered on a delivery stack. Various solutions for delivery of sheets to the delivery stack are known for this purpose. One solution for delivering a sheet on a delivery stack is to automatically grip the sheet at the exit of the printing press and to convey it to the delivery tray. However, this requires an accurate and expensive control of the process, which reduces the operational reliability and increases the costs.

SUMMARY OF THE INVENTION

The purpose of the invention is thus to provide a cost-effective and reliable gripping arrangement for the stacker or delivery tray of a printing press. According to the invention, at least one upper gripper arm and at least one lower gripper arm that have a first open position and a second closed position, whereby sheets are located in the second closed position between the upper and lower gripper arms, and a first guiding device for guiding the gripper arrangement substantially in the vertical direction and a second guiding device for guiding the gripper arrangement substantially in the horizontal direction are provided.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
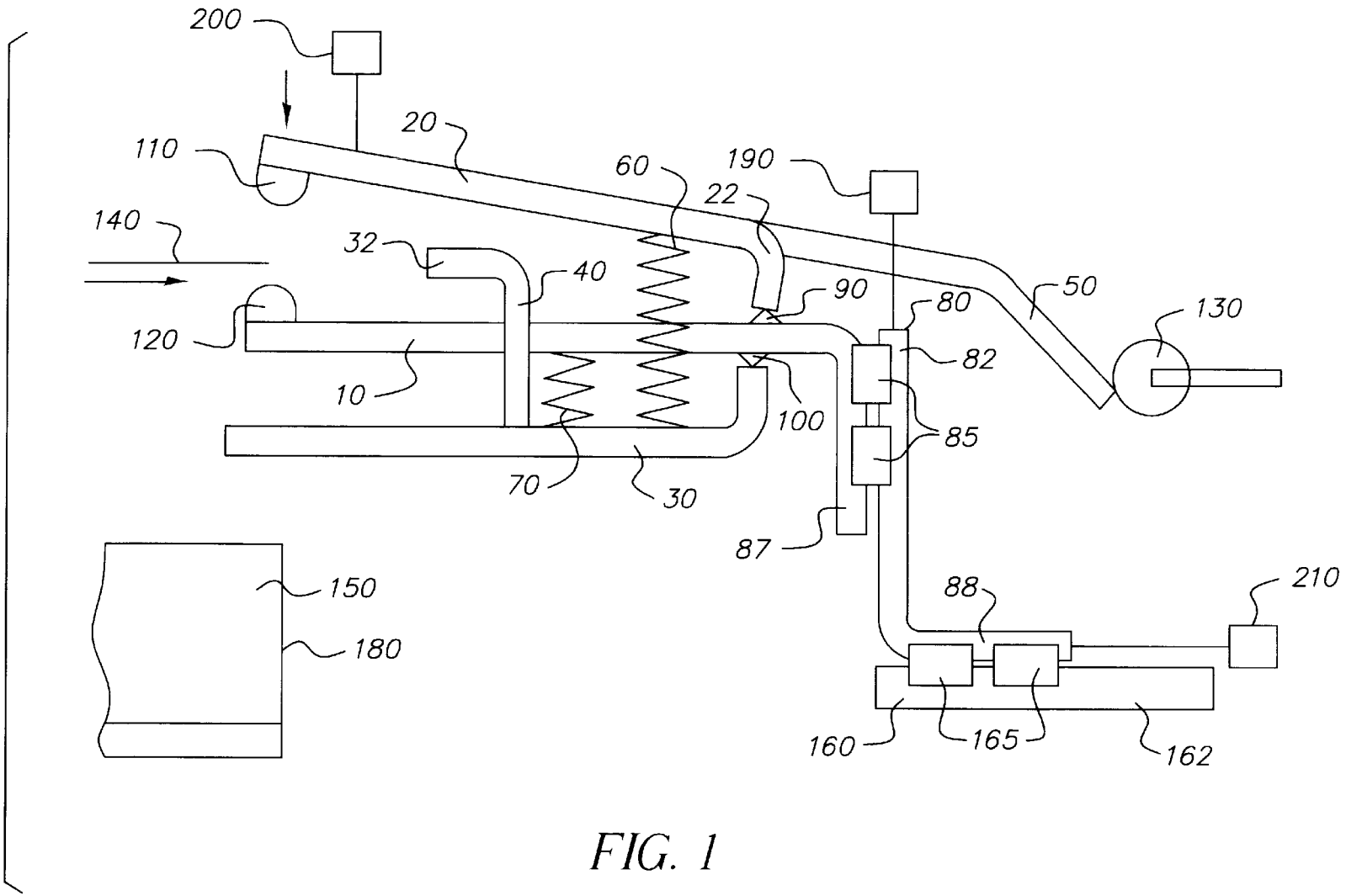
FIG. 1 is a side view of a gripping arrangement, according to the invention, in the first opened position prior to the feeding of a sheet thereto.

FIG. 1 illustrates a side view of gripping arrangement, according to the invention, in the first opened position prior to the feeding of a sheet 140. The figure shows a sheet stack 150 as part of a stacker of a printing press, with a first guiding device 80. The first guiding device 80 has a vertical guide rail 82 with a guide block 85 of a linear guide. A second guiding device 160 is provided with a horizontal guide rail 162. An upper gripper arm 20, with a bent lever 50 on one of its ends, has a gripper nose 110 on its second end and an extension 22 that is perpendicular to the upper gripper arm 20 extending downward. A lower gripper arm 10, with a gripper nose 120 facing the gripper nose 110, is associated with a releasing gripper arm 30 with a substantially perpendicular spacer 40 that extends upward on one of its ends.

The spacer 40 extends in the direction of the upper gripper arm 20 has an extension 32 running parallel to the releasing gripper arm 30 on the end facing away from the releasing gripper arm 30. The movements of the spacer 40 are independent of the movements of the lower gripper arm 10 and these are not attached to each other. The releasing gripper arm 30 is connected by a tension spring 60 with the upper gripper arm 20. Further, the releasing gripper arm 30 is connected by a pressure spring 70 with lower gripper arm 10. Arm 87 extends substantially perpendicular to lower gripper arm 10, between the upper gripper arm 20 and the releasing gripper arm 30, and the guide block 85 has been attached thereto.

In addition to the upper gripper arm 20, a limit stop 130 for the lever 50 is provided. The first and the second guiding devices 80 and 160, or linear guides, are joined by a bent arm 88, which extends on one side vertically upward and which contains the vertical guide rail 82 of the first guiding device 80, and extends on its other side at approximately a 90° angle horizontally in the lateral direction and parallel to the guide rail 162.

The upper gripper arm 20 and the lower gripper arm 10 are shown in FIG. 1 at a distance from each other in the first opened position. The gripper noses 110, 120 at the end of the gripper arms 10, 20 have a clearance in this position, in which a sheet 140 can be inserted between the gripper noses as shown by the direction arrows. The sheet 140 can also be fed transversally to the direction arrow. When the sheet 140 is located between the upper gripper arm 20 and the lower gripper arm 10, a suitable mechanism 200 can be used that brings the gripper arms 10, 20 closer together and the gripper noses 110, 120 grip the sheet 140 and hold it. This position, referred to as the second closed position, is illustrated in FIG. 2.

Figure 2:
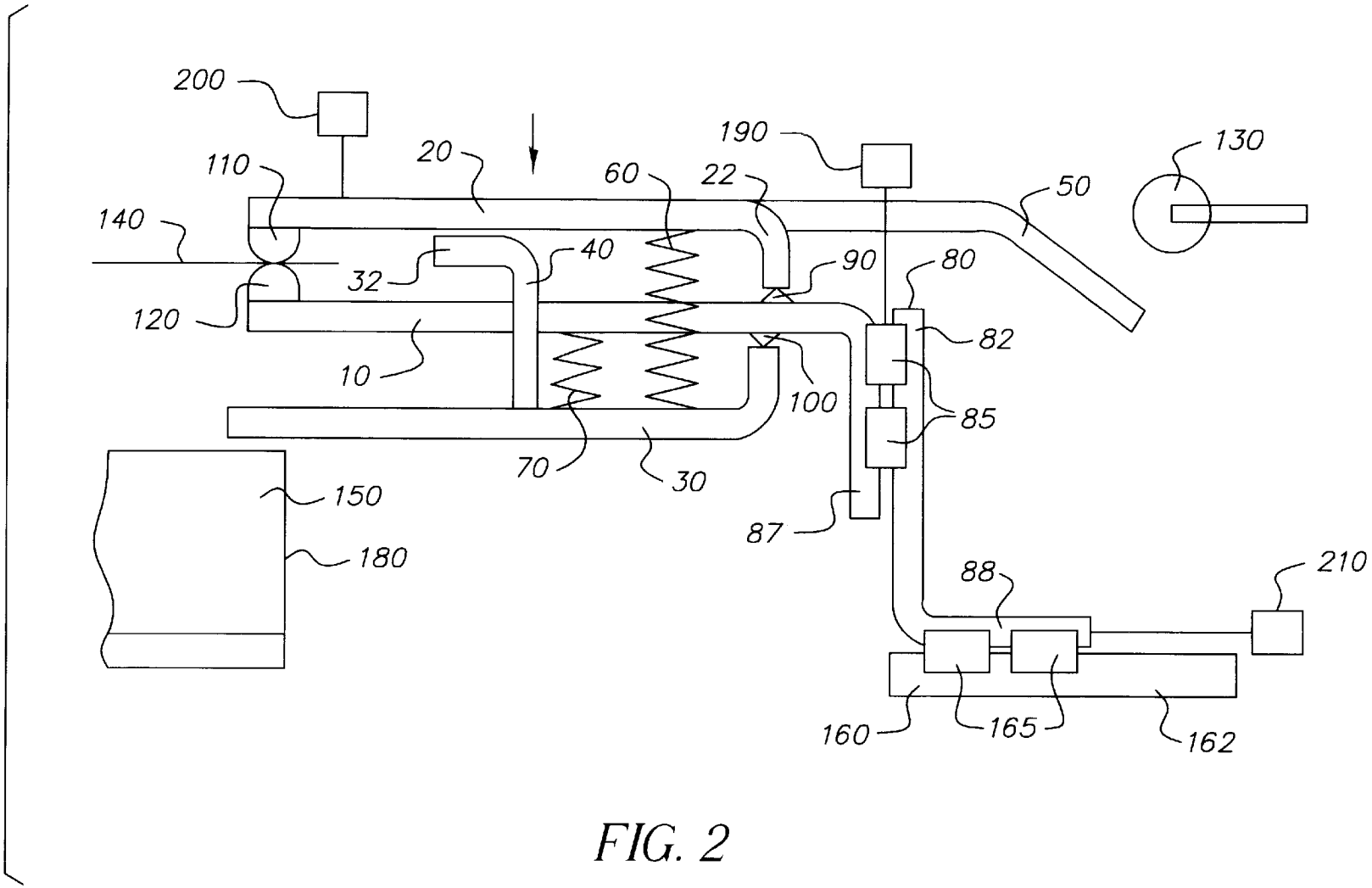
FIG. 2 is a side view of the gripping arrangement, according to the invention, in the second closed position after the release to bring together the upper and lower gripper arms with a sheet between them.

In FIG. 2, the guide block 85 on the guide rail 82 moves from above to below, and the guide block 165 is located to the far left on the guide rail 162, as illustrated in FIG. 1. The sheet 140 is located between the gripper noses 110, 120 above the sheet stack 150, on whose delivery edge 180 the sheet 140 is to be delivered. Next, the guide block 85 on the guide rail 82 moves vertically downward. The guide block 85 is driven by a mechanism, shown schematically as element 190, such as, for example, pneumatic or hydraulic cylinders or by disk cams.

Figure 3:
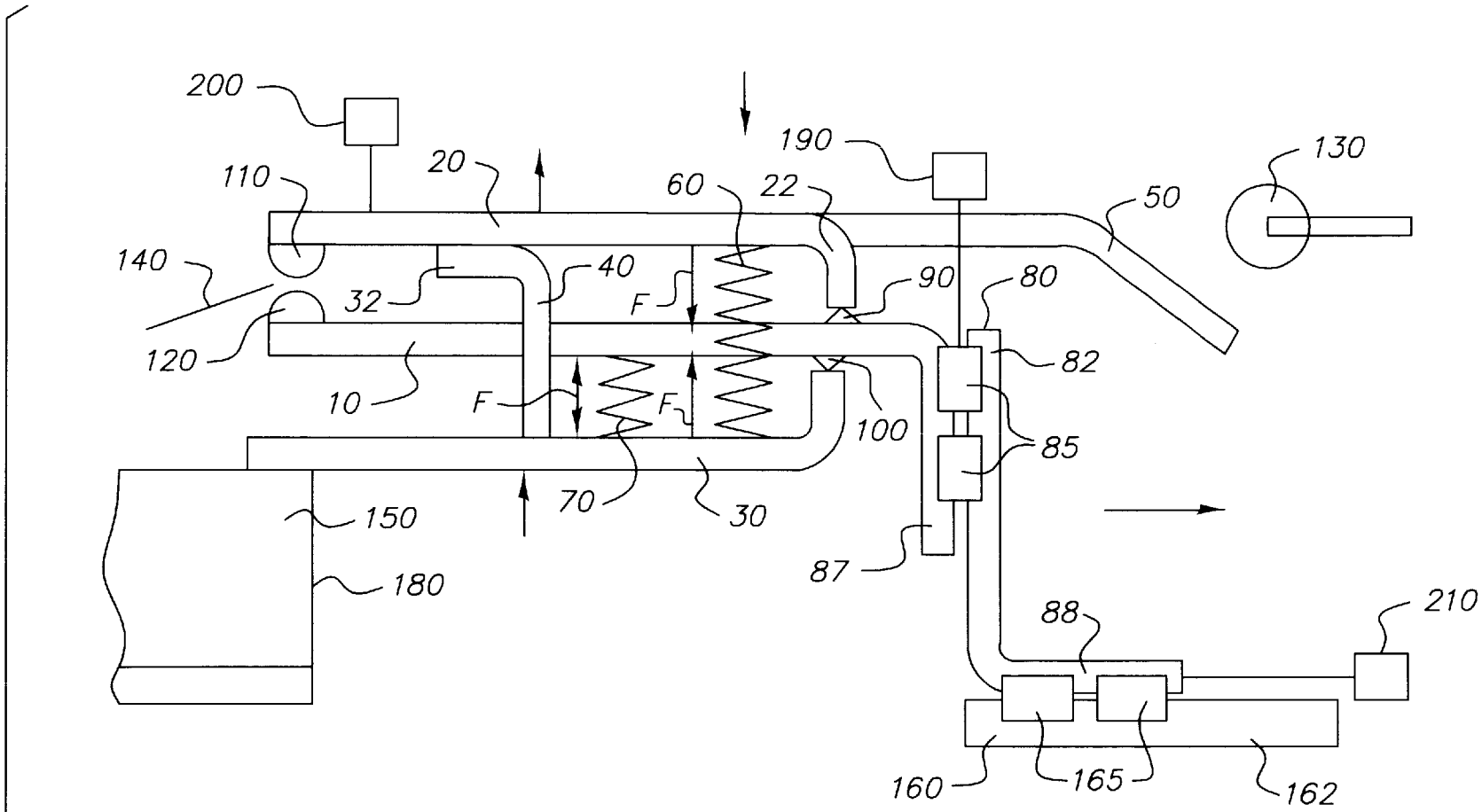
FIG. 3 is a side view of the gripping arrangement, according to the invention, with its opening upper gripper arm, whereby the sheet is delivered on the sheet stack.

The releasing gripper arm 30 is brought closer to the sheet stack 150 by the downward movement. When the releasing gripper arm 30 touches the sheet stack 150 and moves further downward due to the downward movement of the guide block 85, the releasing gripper arm 30 is moved upward from the sheet stack 150 about the pivot point 100. Since the upper gripper arm 20 is contacted by the extension 32 of the spacer 40, the upper gripper arm 20 is accordingly moved upward about pivot point 90, and the gripper noses 110, 120 open. Since the lower gripper arm is fixed, the sheet 140 is released and delivered on the sheet stack 150. This is the position shown in FIG. 3, in which the gripper noses 110, 120 release the sheet 140.

Figure 4:
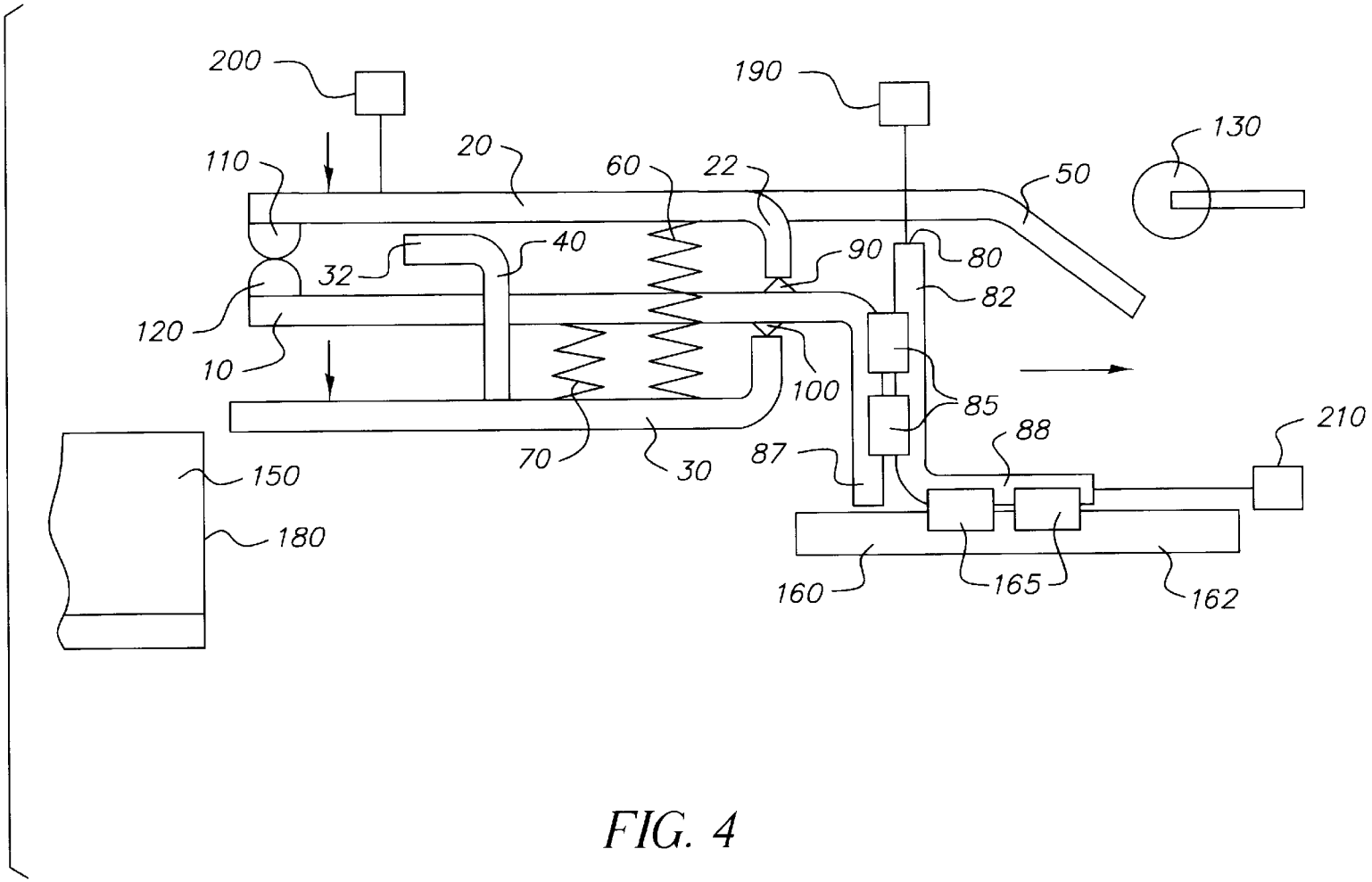
FIG. 4 is a side view of the gripping arrangement, according to the invention, in the second closed position.

Now the guide block 165 is moved, by a suitable mechanism 210, in the direction of the arrow on the horizontal guide rail 162 in the horizontal direction. The sheet 140 is now perfectly delivered at the delivery edge 180 of the sheet stack 150. When the releasing gripper arm 30 leaves the sheet stack 150 due to the movement of the guide block 165, the tension of the tension spring 60, as indicated by both of the force arrows directed inwardly, causes the upper gripper arm 20 to return to its original position. This means that the gripper noses 110, 120 are in direct contact and returned to the second closed position, as illustrated in FIG. 4. The small arrows on the upper gripper arm 20 and on the releasing gripper arm 30 indicate their movement direction after the release of the releasing arm 30 from the sheet stack 150, whereby the force causing the movement is substantially stored in the tension spring 60.

Figure 5:
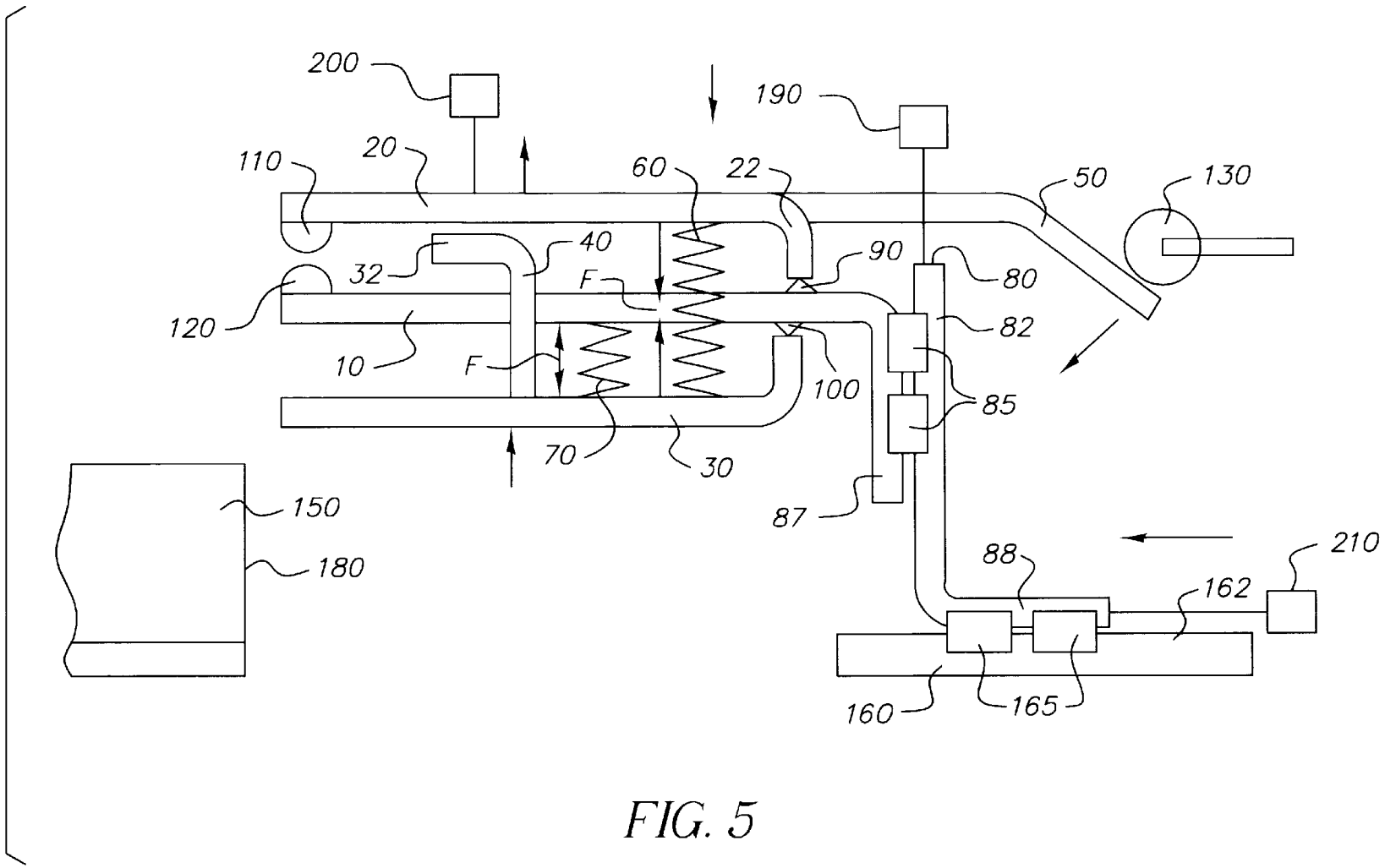
FIG. 5 is a side view of the gripping arrangement, according to the invention, with the open upper and lower gripper arms for picking up another sheet.

The upper gripper arm 20 moves away again from the lower gripper arm 10, i.e., the first opened position is reset when the lever 50, due to the horizontal movement of the guide block 165, and the entire gripper arrangement meet at the limit stop 130, whereby the upper gripper arm 20 is turned about the pivot point 90. The lever 50 is thus pressed diagonally downward by the limit stop 130. The left end of the upper gripper arm 20 to the left of the pivot point 90 moves upward and the right end of the upper gripper arm 20 to the right of the pivot point 90 is moved downward, as illustrated in FIG. 5. The arrow directed approximately vertically upward in FIG. 5 indicates the movement direction of the upper gripper arm 20 and of the gripping arrangement; and the arrow directed horizontally to the left indicates the movement direction of the gripping arrangement and of the guide block 165 on the horizontal guide rail 162. When the guide block 85 is moved vertically upward approximately at the end of the vertical guide rail 82, the gripping arrangement is returned to the position according to FIG. 1, and is ready to pick up another sheet 140, which is delivered by the printing press. The process described is repeated as often as desired, until no more sheets 140 are delivered and a printing job is finished.

The invention has been described in detail with particular reference to certain preferred embodiments thereof, but it will be understood that variations and modifications can be effected within the spirit and scope of the invention.

| PARTS LIST | |
|---|---|
| 10 | Lower gripper arm |
| 20 | Upper gripper arm |
| 22 | Extension |
| 30 | Releasing gripper arm |
| 32 | Extension |
| 40 | Spacer |
| 50 | Lever |
| 60 | Tension spring |
| 70 | Pressure spring |
| 80 | First guiding device |
| 82 | Vertical guide rail |
| 85 | Guide block |
| 87 | Arm |
| 88 | Bent arm |
| 90 | Pivot point |
| 100 | Pivot point |
| 110 | Gripper nose |
| 120 | Gripper nose |
| 130 | Limit stop |
| 140 | Sheet |

-continued

| PARTS LIST | |
|---|---|
| 150 | Sheet stack |
| 160 | Second guiding device |
| 162 | Horizontal guide rail |
| 165 | Guide block |
| 190 | Guide block drive mechanism (vertical) |
| 200 | Gripper mechanism |
| 210 | Guide block drive mechanism (horizontal) |

What is claimed is:

1. Gripping arrangement for a stacker for a printing press, characterized by at least one upper gripper arm (20) and at least one lower gripper arm (10), said at least one upper gripper arm and said at least one lower gripper arm are movable to a first opened position and a second closed position, whereby sheets (140) are located between the upper gripper arm (20) and the lower gripper arm (10) in said second closed position, and a first guiding device (80) for guiding said gripping arrangement substantially in the vertical direction, and a second guiding device (160) for guiding said gripping arrangement substantially in the horizontal direction.

2. Gripping arrangement for a stacker for a printing press according to claim 1, characterized by a releasing gripper arm (30), and said upper gripper arm (20) and said lower gripper arm (10) connected by a tension spring (60, 70) to said releasing gripper arm (30).

3. Gripping arrangement for a stacker for a printing press according to claim 2, characterized in that said releasing gripper arm (30) and said upper gripper arm (20) are positioned so that they can be pivoted on the lower gripper arm (10).

4. Gripping arrangement for a stacker for a printing press according to claim 3, characterized by a spacer (40) between said upper gripper arm (20) and said releasing gripper arm (30).

5. Gripping arrangement for a stacker for a printing press according to claim 4, characterized by a release mechanism (200) for moving said upper gripper arm (20) and said lower gripper arm (10) to said second closed position.

6. Gripping arrangement for a stacker for a printing press according to claim 1, characterized by gripper noses (110, 120) on the ends of said upper gripper arm (20) and said lower gripper arm (10) for selectively gripping sheets (140) therebetween.

7. Method for using the gripping arrangement having at least one upper gripper arm (20) and at least one lower gripper arm (10), characterized by movement of said at least one upper gripper arm (20) and said at least one lower gripper arm (10) to a first opened position, in which the ends of said upper gripper arm (20) and said lower gripper arm (10) gripping the sheet are kept apart, the feeding of a sheet (14) between the ends of the upper gripper arm (20) and the lower gripper arm (10), the movement of said at least one upper gripper arm (20) and said at least one lower gripper arm (10) to a second closed position by moving the ends of said upper gripper arm (20) and said lower gripper arm (10) closer together and the gripping of the sheet (140) by a release of said upper gripper arm relative to said lower gripper arm, the moving of said gripping arrangement in the vertical direction toward the stacker, the pressing of a releasing arm (30) by a spacer in reaction to the movement of the gripping arrangement against the stacker, thus producing said first opened position in which the ends of said upper gripper arm (20) and said lower gripper arm (10) are apart, the delivery of a sheet (140) on the stacker, the moving away of the gripping arrangement in the horizontal and vertical direction and the release of said releasing gripper arm (30) by movement of the gripping arrangement, thus producing the second closed position.

* * * * *